US005284467A

United States Patent [19]

Meschi

[11] Patent Number: 5,284,467

[45] Date of Patent: Feb. 8, 1994

[54] SHEET STOPPING SYSTEM FOR A HIGH SPEED FOLDING MACHINE FOR A CONTINUOUS PAPER BOND

[75] Inventor: Luciano Meschi, Livorno, Italy

[73] Assignee: Industria Grafica Meschi SRL, Livorno, Italy

[21] Appl. No.: 848,954

[22] PCT Filed: Oct. 2, 1991

[86] PCT No.: PCT/EP91/01905

§ 371 Date: Apr. 23, 1992

§ 102(e) Date: Apr. 23, 1992

[87] PCT Pub. No.: WO92/06032

PCT Pub. Date: Apr. 16, 1992

[30] Foreign Application Priority Data

Oct. 3, 1990 [IT] Italy ..... 21874 B/90

[51] Int. Cl.[5] ..... B65H 45/101; B65H 45/16

[52] U.S. Cl. ..... 493/412; 493/433

[58] Field of Search ..... 493/410, 411, 412, 413, 493/414, 415, 420, 433

[56] References Cited

U.S. PATENT DOCUMENTS

| | | | |
|---|---|---|---|
| 663,667 | 12/1900 | Ross et al. | 493/433 |
| 727,304 | 5/1903 | Dauvergne | 493/414 |
| 1,606,459 | 11/1926 | Waterworth | 493/420 |
| 3,037,768 | 6/1962 | Anderson et al. | 493/433 |
| 4,358,285 | 11/1982 | Fujino | 493/411 |
| 4,494,948 | 1/1985 | Teyssier | 493/412 |
| 5,064,179 | 11/1991 | Martin | 493/414 |

FOREIGN PATENT DOCUMENTS 0368392 5/1990 European Pat. Off. .

*Primary Examiner*—William E. Terrell

*Attorney, Agent, or Firm*—McAulay Fisher Nissen Goldberg & Kiel

[57] ABSTRACT

A sheet stopping system for a folding machine for the folding of a sheet in the form of a continuous band in a zig-zag like manner, in which the folding machine comprises a supporting plane (18) onto which means associated with the sheet in the form of the continuous band is fed to have it impinge alternately against hinderances (24, 26) limiting one of the two opposite sides of the supporting plane (18). The sheet supporting system includes the supporting plane and pairs of vertically slidable fingers (38*a*, 38*b*) projecting downwardly from the hinderance for engaging the supporting plane (18) to prevent the introduction of a sheet starting portion between the hinderance and the supporting plane (18).

19 Claims, 2 Drawing Sheets

SHEET STOPPING SYSTEM FOR A HIGH SPEED FOLDING MACHINE FOR A CONTINUOUS PAPER BOND

The present invention relates to an improved sheet stop system against the collecting plane of a folding machine for a continuous paper band and is particularly applicable as an improvement of the high speed folding machine of the type described and claimed in the Italian Patent Application No. 22 536 A/88, filed on Nov. 27, 1988 in the name of the same applicant as the present one. This prior Italian application corresponds to U.S. patent application Ser. No. 430,512, filed Nov. 1, 1989, now abandoned and replaced with a continuation application Ser. No. 744,816 filed Aug. 12, 1991, and now allowed, U.S. Pat. No. 5,139,247.

Looking at the figures of the above Patent Application, a folding machine according to that invention consists of a supporting frame 10, in which a supporting plane 18 and two cylinder rollers 20 and 22 are housed, the said rollers being driven into rotation according to each other in opposed directions, and provided with hindering means 24 and 26 for preventing the starting portion of a continuous paper band from erroneously entering between either roller 20 and the said supporting plane 18. The hindering means 24 and 26 are provided with upper reliefs, 32 and 36 respectively, engaging grooves 40 and 44 formed in the rollers 20 and 22, and with lower reliefs, 34 and 38 respectively, engaged with side grooves 42 and 46 formed by milling the said supporting plane 18.

It is technically difficult and economically expensive to form said side grooves 42 and 46 in the said supporting plane 18. However by merely eliminating the lower reliefs 34 and 38, the present invention is directed to an apparatus which now prevents the starting or beginning portion of a continuous paper band from a possibly erroneous entering between the hindering means 24, 26 and the supporting plane 18.

The object of the present invention is that of avoiding said side milled grooves 42 and 46, it being however allowed to effectively stop the said starting portion of the paper continuous band between either hindering means 24 or 26 and the supporting plane 18. Said purpose is attained by providing a completely smooth supporting plane and by replacing the lower reliefs of the hindering means with pairs of vertically slidable fingers, positioned at the ends of said hindering means, which engage said supporting plane strictly enough to prevent the entering of the band starting portion between the hindering means and said supporting plane.

Preferably, said fingers consist of lower rod portions, abutting against said supporting plane, slidable with respect to supports fastened to said hindering means to follow possible movements of said supporting plane owing to the formation of a continuous folded band package on said plane, compelling the plane itself to lower.

In a preferred embodiment, said fingers consist of lower hollow rods in which are inserted upper solid rods fastened to said hindering means and slidable with respect to the hollow rods themselves for taking into account the supporting plane movement.

Alteratively, said fingers consist of solid lower rods inserted in hollow upper rods fastened to said hindering means and slidable with respect to the solid rods themselves for taking into account the supporting plane movement.

Preferably, the lower rods of said fingers are provided with bevelings on the side opposite to the one in which the paper band contacts the fingers and the supporting plane. More preferably, said lower rods are provided with a second beveling, contiguous and adjacent to the first one, transferring the support portion of the fingers substantially to a line at the region in which the paper band contacts the fingers themselves and the supporting plane for transferring the whole load of said fingers to the contact line with the paper band.

Further, between the movable portions and the fixed portions of said fingers can be interposed resilient means to improve the abutting strength of said fingers on said support plane.

The above listed features of the present invention, together with further features and advantages thereof, will be more apparent from the following detailed description of an embodiment provided with the enclosed drawings, wherein.

Figure 1:
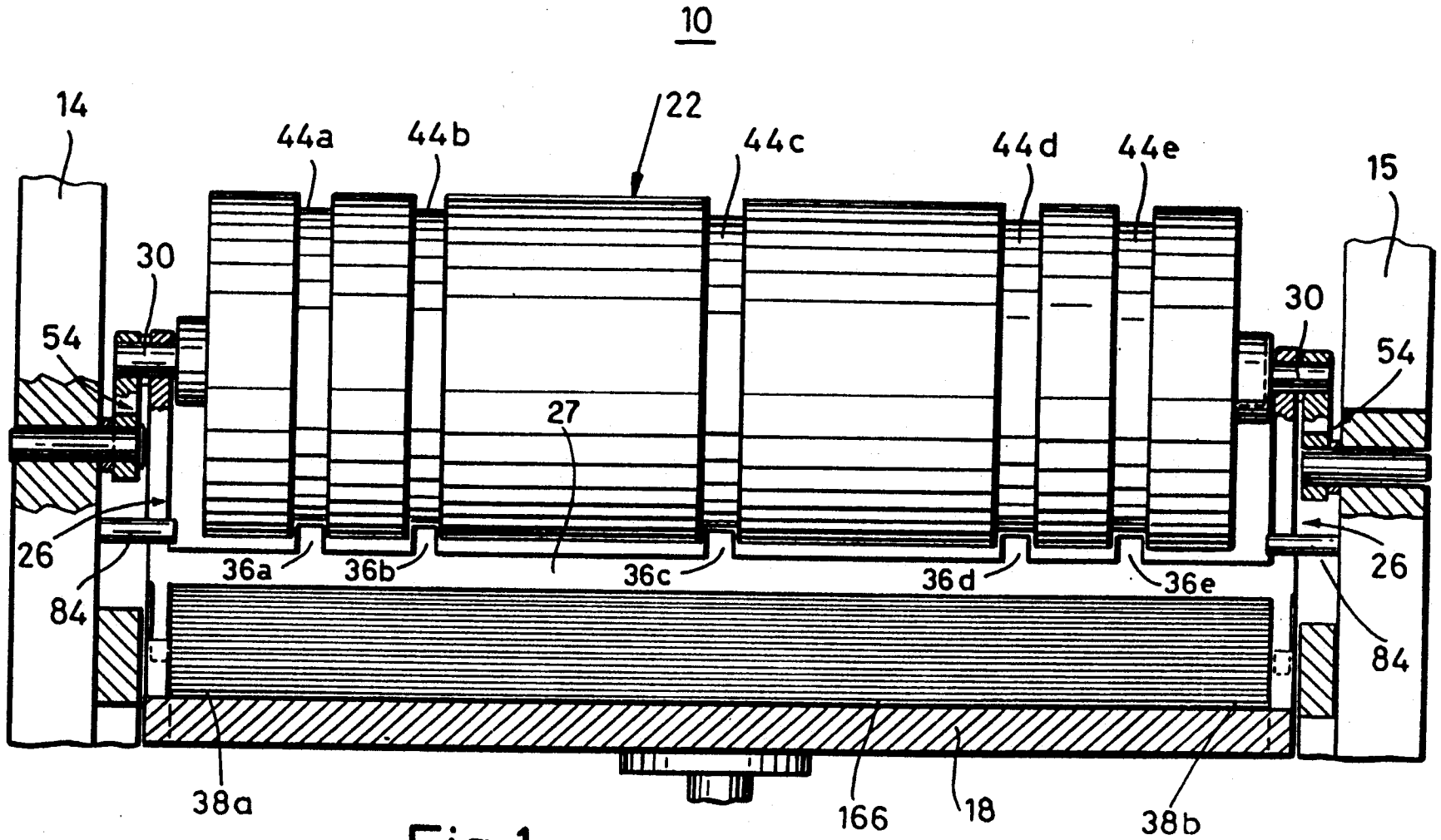
FIG. 1 is a lateral view of a portion of folding device, depicted in the above indicated Italian patent application, embodying the improved hindering system according to the present invention.

It should be noted that, for simplicity of explanation, only the pertinent portions of the apparatus of my earlier patent have been reproduced with the improved features, and it should be understood that the improved features apply to all of the structure of my earlier apparatus.

Referring to the figures, in which have been used, where possible, the same numerals used in the above mentioned Italian patent application and having in mind the specification and the drawings thereof, it is seen that in a high speed folding machine 10, comprising a support plane 18 on which abuts a package 166 of folded paper band, a roller 22 (roller 20 is not shown because the teachings of the invention as applied to roller 22 also apply to roller 20) turnable by means of pivots 30 in supports 54, in turn supported by frame members 14 and 15 of the folding machine 10 which are provided to begin the folding of the paper band and hindering means 26, supported by said pivots 30 and bound in the movement by stops 84, stopping said paper package 166. The hindering means 26 are formed by a crossbar 27 from which upwardly protrude some fingers **36*a–e* engaging some grooves 44*a–e* cut in the surface of the roller 22 and two retractable fingers 38*a* and 38*b* extend downwardly contacting the supporting plane 18**, abutting thereon along the whole permitted down stroke.

Figure 2:
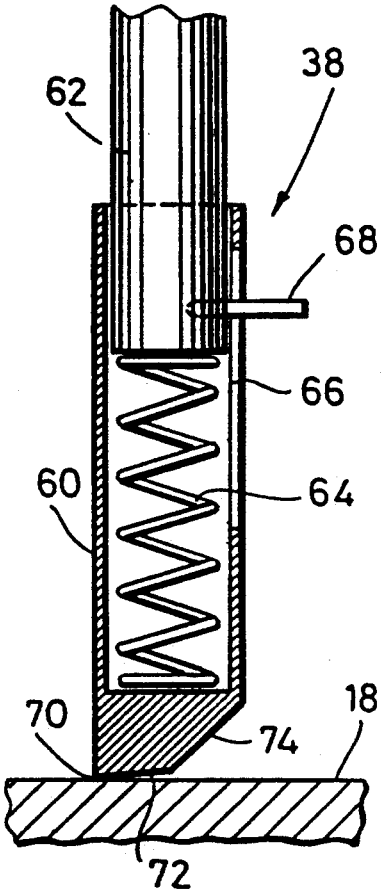
FIG. 2 is a partial view in lateral cross-section of an end portion of a sliding finger according to the present invention.
Figure 3:
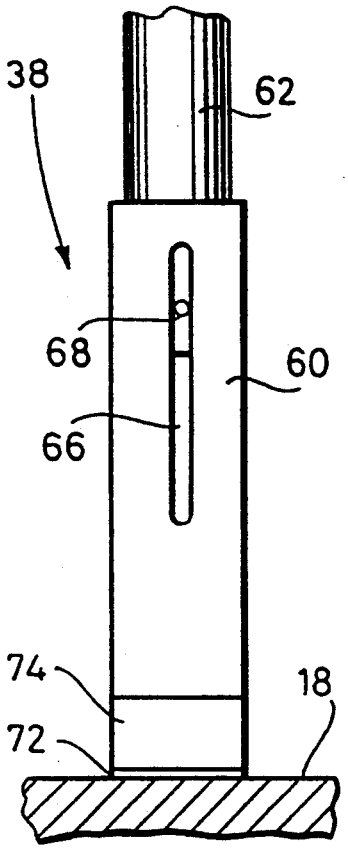
FIG. 3 is a partial view, looking from outside to inside, of the end portion itself depicted in FIG. 2.

To understand the structure of said retractable fingers **38*a* and 38*b*, reference is made to FIGS. 2 and 3. From these figures it is seen that one of said fingers 38 consists of a hollow rod or shell 60 receiving a sliding solid rod 62, held in abutment against the plane 18 by its own weight or, possibly, by the help of a spring 64 housed in the shell 60, being the shell 60 bound in the stroke with respect to the rod by a slot 66 housing a pin 68 fastened to said rod 62. The shell 60 to efficiently prevent an erroneous entering of the starting portion of the paper band under the hindering means 26 comprises a fore corner 70**, facing the paper, followed by a first beveling 72 permitting to load the substantially whole force of the weight, and possibly of the spring 64, on the corner 70 of the shell 60, assuring a very good adhesion between the shell 60 and the plane 18.

Possibly, for convenience purposes, the first beveling 72 can be followed by a second more relieved beveling 74.

The operation of the present invention is the following one:

When a paper package 166 begins to be formed on a supporting plane 18, the starting region of the paper band comes to the hindering means 26, abutting against anyone point between the roller 22 and the supporting plane 18. At this time the supporting plane 18 is in its top position, compelling the retractable fingers 38*a*, 38*b* to be contracted to the minimum allowed length.

The fingers 38*a*, 38*b* are at least two in number to allow a safe stop of the starting portion of the paper band. Further, the beveling 72, advancing the corner 70, transfers substantially the whole force due to the weight of the hollow rod or shell 60 and possibly to the spring 64, on the corner itself producing along said corner such a high pressure to prevent at any rate the paper from lifting the fingers 38*a*, 38*b*; all the more that the beginning of the paper band never comes against the fingers in a grazing direction with respect to the collecting plane 18, but it is always tilted enough to help in pushing downside and thus in more and more closing the fingers 38*a*, 38*b* against the collecting plane 18. Consequently, the paper band never enters between the hindering means 26 and the collecting plane 18. As the paper package 166 grows, its last folding edge is farther and farther from the supporting plane 18 being less and less possible an erroneous entering of paper between the hindering means 26 and the collecting plane 18.

Actually, there could be a danger of a sheet erroneously entering between the hindering means 26 and the roller 22, but to prevent this occurrence there are provided upside directed fingers 36*a–e* of the crossbar 27 cooperating with the grooves 44*a–e* in the roller 22.

Due to an excessive growth of the package 166, the whole space between the supporting plane 18 and the roller 22 could be filled, which needs to consequently lower the plane 18 to allow a further growing of the package 166. The retractable fingers 38*a*, 38*b* of the present invention always follow the descent of the plane 18, allowing in any case to stop the paper of the package 166.

The present invention has been described as a preferred embodiment, but it is meant that possible changes and variations obvious for those skilled in the art are feasible without going out from the scope thereof. For example, the retractable fingers 38*a*, 38*b* could be made in a reversed way with respect to what depicted in the FIGS. 2 and 3 with the parts 60 consisting of solid rods and the parts 62 consisting of hollow rods.

I claim:

1. In a folding machine for the folding of a sheet in a form of a continuous band in a zig-zag like manner, an improved sheet stopping system therefor, in which the folding machine comprises a supporting plane (18) having means for the gradual lowering thereof and means associated with said supporting plane for feeding and alternately guiding the sheet in the form of the continuous band to said supporting plane and to have it impinge alternately against a first and a second hindering means (24, 26) each limiting one of the two opposite sides of said supporting plane (18), said improved sheet stopping system comprising:

said supporting plane (18); and pairs of vertically slidable fingers (38*a*, 38*b*) projecting downwardly from each said hindering means (26) and, placed at the ends thereof for engaging said supporting plane (18) to prevent the introduction and entering of a sheet starting portion forming part of the continuous band into an area between said hindering means (26) and said supporting plane (18).

2. In the machine of claim 1, wherein said fingers (38) each comprise a lower rod portion (60) having a fore corner (70) for abutting against said supporting plane (18) and an upper support (62) fastened to said hindering means (26), said lower rod portion (60) together with said fore corner (70) being slidable relative to said supporting plane (18) and said fore corner (70) being movable relative to said support (62) for maintaining contact with said supporting plane to follow possible movements of said supporting plane (18) as a result of the formation of a package (166) of the continuous folded band formed on said plane to cause said supporting plane (18) to be gradually lowered.

3. In the machine of claim 1, wherein said fingers (38) include a lower rod (60) and an upper rod movable relative to said lower rod, and means fastening said fingers (38) to said hindering means (26) while permitting said upper and said lower rods to move relative to each other for taking into account and to follow the movement of said supporting plane (18).

4. In the machine of claim 1, wherein said fingers (38*a*, 38*b*) comprise a telescopic structure including a solid lower rod slidable in an upper hollow rod fastened to said hindering means (26) and slidable with respect to said supporting plane (18) for taking into account movement of said supporting plane (18).

5. In the machine of claim 2, wherein said lower rod (60) is provided with a beveling (72) proximate to said fore corner (70) and on a side opposed to that to which the paper contacts said fingers (38*a*, 38*b*) and said supporting plane (18).

6. In the machine of claim 5, wherein said lower rod (60) is provided with a second beveling (74) contiguous to and adjacent to said first beveling (72), for transferring said fore corner (70) forming an abutting portion of said fingers (38*a*, 38*b*) to a substantial line corresponding to a portion in which the band contacts said fore corner (70) of said fingers (38*a*, 38*b*) and said supporting plane (18) for transferring the whole load of said fingers (38*a*, 38*b*) to a contact line with the band.

7. In the machine of claim 3, including spring means (64) interposed between movable portions of said rods and fixed portions of said fingers (38*a*, 38*b*) for aiding the abutting of said fingers (38*a*, 38*b*) on said supporting plane (18) and aiding the abutting strength of said fingers (38*a*, 38*b*) onto said supporting plane (18).

8. In the machine of claim 4, wherein said lower rod (60) is provided with a beveling (72) on a side opposed to that in which the paper contacts said fingers (38*a*, 38*b*) and said supporting plane (18).

9. In the machine of claim 3, wherein said lower rod (60) is provided with a beveling (72) on a side opposed to that in which the paper contacts said fingers (38*a*, 38*b*) and the supporting plane (18).

10. In the machine according to claim 8, wherein said lower rod (60) is provided with a second beveling (74), contiguous and adjacent to said first beveling (72), for transferring an abutting portion (70) of the fingers (38*a*, 38*b*) to a substantial line corresponding to a portion in which the band contacts said fingers (38*a*, 38*b*) and said supporting plane (18) for transferring the entire load of said fingers (38*a*, 38*b*) to a contact line with the continuous band.

11. In the machine according to claim 9, wherein said lower rod (60) is provided with a second beveling (74), contiguous to said first-mentioned beveling (72), for transferring an abutting portion (70) of the fingers (38*a*, 38*b*) to a substantial line corresponding to a portion in which the continuous band contacts said fingers (38*a*, 38*b*) and said supporting plane (18) for transferring the whole load of said fingers (38*a*, 38*b*) to a contact line with the continuous band.

12. In the machine according to claim 2, including spring means (64) interposed between said rods to aid maintaining contact with said supporting plane and contacting strength of said fingers (38*a*, 38*b*) on said supporting plane (18).

13. In the machine according to claim 11, including spring means (64) interposed between said lower rod (60) and said upper rod (62) for helping the abutting strength of said fingers (38*a*, 38*b*) onto said supporting plane (18).

14. In the machine according to claim 10, including spring means (64) interposed between said lower rod (60) and said upper rod (62) for aiding the abutting strength of said fingers (38*a*, 38*b*) on said supporting plane (18).

15. In the machine according to claim 1, wherein said fingers (38*a*, 38*b*) comprise lower hollow rods (60) having inserted therein solid upper rods (62) fastened to said hindering means (26) and slidable with respect thereto for taking into account the movement of said supporting plane.

16. In the machine according to claim 15, wherein said lower rod (60) is provided with a beveling (72) on a side opposed to that in which the paper contacts said fingers (38*a*, 38*b*) and the supporting plane (18).

17. In the machine according to claim 16, wherein said lower rod (60) is provided with a second beveling (74), contiguous to said first beveling (72) and adjacent thereto, transferring an abutting portion (70) of the fingers (38*a*, 38*b*) themselves to a substantial line corresponding to a portion in which the paper band contacts said fingers (38*a*, 38*b*) and said supporting plane (18) for transferring the entire load of said fingers (38*a*, 38*b*) to a contact line with the paper band.

18. In the machine according to claim 1, wherein said supporting plane (18) is completely smooth.

19. In the machine according to claim 2, wherein said vertically sliding fingers are positioned at the end of said hindering means.

* * * * *

UNITED STATES PATENT AND TRADEMARK OFFICE

CERTIFICATE OF CORRECTION

PATENT NO. : 5,284,467

DATED : February 8, 1994

INVENTOR(S) : Luciano Meschi

It is certified that error appears in the above-identified patent and that said Letters Patent is hereby corrected as shown below:

On the title page, Item

[54] Title: SHEET STOPPING SYSTEM FOR A HIGH SPEED FOLDING MACHINE FOR A CONTINUOUS PAPER BAND Signed and Sealed this Fifth Day of July, 1994

Bruce Lehman

*Attest:*

BRUCE LEHMAN

*Attesting Officer*

*Commissioner of Patents and Trademarks*